US006059398A

United States Patent [19]

Desie et al.

[11] Patent Number: 6,059,398

[45] Date of Patent: May 9, 2000

[54] PRINTHEAD STRUCTURE HAVING ELECTRODES NOT EXTENDING TO THE EDGE OF PRINTING APERTURES

[75] Inventors: Guido Desie, Herent; Jacques Leonard, Antwerp, both of Belgium

[73] Assignee: Agfa-Gevaert, Mortsel, Belgium

[21] Appl. No.: 08/868,387

[22] Filed: Jun. 3, 1997

Related U.S. Application Data

[60] Provisional application No. 60/025,320, Sep. 6, 1996.

[30] Foreign Application Priority Data

Jun. 11, 1996 [EP] European Pat. Off. ..... 962 01 622

[51] Int. Cl.[7] ..... B41J 2/04

[52] U.S. Cl. ..... 347/55

[58] Field of Search ..... 347/55, 120, 123, 347/111, 159, 141, 151, 127, 128, 17, 153, 154; 399/271, 290, 291, 292, 293, 294, 295

[56] References Cited

U.S. PATENT DOCUMENTS

| | | | |
|---|---|---|---|
| 5,214,451 | 5/1993 | Schmidlin et al. . | |
| 5,606,402 | 2/1997 | Fujita et al. . | |
| 5,781,217 | 7/1998 | Desie | 347/55 |

FOREIGN PATENT DOCUMENTS

| | | |
|---|---|---|
| 0435549 | 12/1990 | European Pat. Off. . |
| 0720072 | 12/1995 | European Pat. Off. . |
| WO94/26527 | 11/1994 | WIPO . |

OTHER PUBLICATIONS

Patent Abstracts of Japan, vol. 010, No. 295 (M–523), Oct. 7, 1986 and JP–A–61 110567 (Nippon Telegr & Teleph Corp.) May 28, 1986.

*Primary Examiner*—John Barlow
*Assistant Examiner*—Raquel Yvette Gordon
*Attorney, Agent, or Firm*—Baker & Botts, L.L.P.

[57] ABSTRACT

A printhead structure is provided comprising individual control electrodes (106*a*) in combination with printing apertures (107) and a shield electrode (106*b*), both electrodes separated by an insulating material wherein both the shield electrode and the control electrodes have openings and either the shield electrode or each of the control electrodes does not reach as far as the edges of the printing apertures. The linear dimension of the openings in the shield electrode or in each of the control electrodes is at least 1.1 times larger than the longest linear dimension of each of the printing apertures present in the openings. A DEP device using such a printhead structure is also disclosed.

10 Claims, 3 Drawing Sheets

PRINTHEAD STRUCTURE HAVING ELECTRODES NOT EXTENDING TO THE EDGE OF PRINTING APERTURES

This application claims the benefit of U.S. Provisional Application Ser. No. 60/025,320 filed Sep. 6, 1996.

FIELD OF THE INVENTION

This invention relates to an apparatus for use in the process of electrostatic printing and more particularly to a printhead structure for use in Direct Electrostatic Printing (DEP). In DEP, electrostatic printing is performed directly from a toner delivery means on a receiving member substrate by means of an electronically addressable printhead structure.

BACKGROUND OF THE INVENTION

In DEP (Direct Electrostatic Printing) the toner or developing material is deposited directly in an imagewise way on a receiving substrate, the latter not bearing any imagewise latent electrostatic image. In the case that the substrate is an intermediate endless flexible belt (e.g. aluminium, polyimide etc.), the imagewise deposited toner must be transferred onto another final substrate. If, however, the toner is deposited directly on the final receiving substrate, a possibility is fulfilled to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

a layer of insulating material, called insulation layer;

a shield electrode consisting of a continuous layer of conductive material on one side of the insulation layer;

a plurality of control electrodes formed by a segmented layer of conductive material on the other side of the insulation layer; and at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode. The printhead structure as described in U.S. Pat. No. 3,689,935 is thus characterised by the presence of two electrode layers and is called hereinafter a P2-printhead structure. The voltages used for image-wise deposition of toner particles are of the order of about 400 V. Such devices have e.g. been described in U.S. Pat. No. 4,755,837.

DEP devices according to the principle, disclosed in U.S. Pat. No. 3,689,935, but using only a single electrode layer, with only control electrodes and no shield electrode have also been described. In e.g. U.S. Pat. Nos. 5,099,271, 5,402,158, EP-A 587 366 and EP-A 617335, devices have been described that operate according to the DEP principle with typical voltages of the order of 50 to 100 V. These printhead structures made from polyimide foils with apertures and control electrodes in a single plane are called further on P1-printhead structures. P1 printhead structures are characterised by a lower voltage needed to get toner images on the final receiver, but also by a higher contrast: i.e. the number of shades of grey between maximum density and minimum is rather low, typically binary.

A DEP device according to the P2-design is well suited to print half-tone images. The density variations present in a half-tone image can be obtained by modulation of the voltage applied to the individual control electrodes. Providing printing apertures in a DEP printhead structure comprising two electrodes (control electrode and shield electrode) separated by an insulating plastic material, to yield a printhead capable of producing images with high resolution and also with uniform density pattern is not an obvious process.

All printing apertures in the printhead structure must have exactly the predetermined diameter, the electrodes must stay in place and have a well defined and constant shape, and the walls of the printing apertures through the insulating plastic must be smooth to avoid clogging of the printing apertures. After forming the printing apertures in the printhead structure, each aperture must be individually addressable such as to be able to yield any density between zero and maximum density. Moreover every printing aperture has to be addressable to the same extent in order to yield smooth density pattern. Applying a controlling voltage of a few hundred of volts between an individual control electrode and the global shield electrode may not short-circuit the nozzle and render it useless.

Printhead structures made from flexprint material, but with a much more complicated design have also been described in the literature. In U.S. Pat. No. 4,912,489 e.g. a printhead structure of polyimide with 3 electrode layers is described. A first sheet of polyimide has a printing aperture having on one side a common shield electrode, and on the other side individual control electrodes. A second sheet of polyimide is laminated upon said first sheet of flexprint material and has printing apertures with the same aperture diameter and registered with a high degree of accuracy with said first sheet with printing apertures. At the side facing away from said first sheet of flexprint material screening electrodes are available, said screening electrodes having a diameter that is larger than the diameter of said apertures.

In U.S. Pat. No. 5,170,185 a printhead structure is described consisting of two sheets of polyimide foil laminated to each other. Both sheets have printing apertures with the same aperture diameter, and both of said printing apertures have to be registered to a high degree of accuracy. A common shield electrode is provided at a first side of said first flexprint material facing away from said lamination side. Said second sheet of flexprint material has individual control electrode at the other side of said laminated printhead structure, also facing away from said lamination side. Said control electrodes in said second sheet of flexprint material have conductive patterns inside said printhead structures as depicted in FIG. 23 said U.S. Pat. No. 5,170,185.

In U.S. Pat. No. 5,038,159 a printhead structure is made from a single sheet of flexprint material but the shape of said printing apertures is made concave in one embodiment of this invention. The aperture diameter is larger at the side of the common shield electrode than at the side of the individual control electrodes. The printing aperture is made in said plastic material in such a way that a concave form is obtained. In a second embodiment of said invention a single sheet of flexprint material is used. The printing aperture has a fixed diameter and the individual control electrodes are through-hole-connected to the shield electrode side. Said shield electrode itself has a much larger diameter so that it remains electrically insulated from said control electrode. This printhead structure is also illustrated in FIG. 2 of said U.S. Pat. No. 5,038,159.

There is thus still a need for a DEP system, using a printhead structure comprising two electrodes (control electrode and shield electrode) separated by an insulating plastic material and wherein printing apertures are present, wherein the printing apertures are not easily clogged by the toner particles and wherein each aperture is individually addressable in a reproducible way by low control voltages, and wherein an image with enhanced grey scale resolution can be obtained, and wherein said printhead structure can be fabricated in an easy and straightforward way.

OBJECTS OF THE INVENTION

It is an object of the invention to provide an improved printhead structure for use in a Direct Electrostatic Printing (DEP) device, printing images with a high density resolution and with a high spatial resolution.

It is a further object of the invention to provide an improved printhead structure for a DEP device combining high spatial resolution with good long term stability and reliability.

It is still a further object of the invention to provide a printhead structure for a DEP device, wherein said printhead structure comprises a control electrode and a shield electrode separated by an insulating material and printing apertures made through both said electrodes and said insulating material wherein said printing apertures are not easily clogged by toner particles and are individually addressable in a stable an reproducible way.

It is another object of the invention to provide a method to make said printhead structure comprising printing apertures through both said electrodes and said insulating material in an easy and economic way.

It is a further object of the invention to provide a DEP device comprising a printhead structure making it possible to print a large tone scale, i.e. a high amount of different density levels.

Further objects and advantages of the invention will become clear from the description hereinafter.

The above objects are realized by providing a printhead structure comprising, an insulating material (106*c*) having a first and a second side, said first side carrying control electrodes (106*a*) associated with printing apertures, said second side carrying a shield electrode (106*b*), wherein i) said printing apertures have a longest dimension A, measured on said side of said insulating material carrying said shield electrode and have a longest dimension D, measured on said side of said insulating material carrying said control electrodes, ii) said shield electrode has openings with a dimension B, measured parallel to said longest dimension A, said dimension B being equal to or larger than said dimension A, iii) said control electrodes have openings with a dimension E measured parallel to said longest dimension D, said dimension E being equal to or larger than said dimension D, iv) in each of said openings at least one printing aperture is present, and v) for each of said printing apertures present in each of said openings, $B/A \geqq 1.10$ and $E=D$.

In an other embodiment of the present invention, $A=B$ and $E/D \geqq 1.10$.

DETAILED DESCRIPTION OF THE INVENTION

Figure 1:
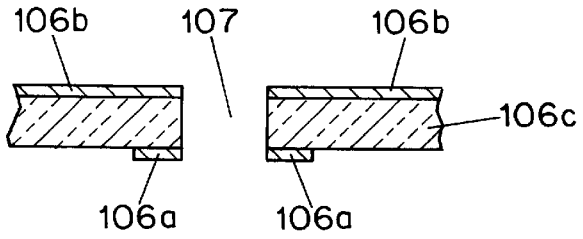
FIG. 1 PRIOR ART
FIG. 1 is a schematic illustration of a prior art printhead structure comprising a shield and control electrodes for use in DEP.

Throughout this document the wording "control electrode" or "control electrodes" is used to indicate the electrodes that are used to control the flow of particles through the printing apertures and that are associated with one or more printing apertures, but a control electrode is never a common electrode for all printing apertures. These "control electrodes" are located on a first side (face) of an insulating material and are isolated from each other, so that different "control electrodes" can have a different voltage.

Throughout this document the wording "shield electrode" is used to indicate a continuous electrode located on a second side (face) of said insulating material, opposite to the side (face) carrying the control electrodes. On the shield electrode a single voltage is present and the shield electrode is a common electrode for all printing apertures.

In the literature many devices have been described that operate according to the principles of DEP (Direct Electrographic Printing). All these devices are able to perform grey scale printing either by voltage modulation or by time modulation of the voltages applied to control electrodes, controlling the flow of toner particles from a toner container to a substrate. We have found that, when printing apertures with small diameter are used in DEP, the image contrast that can be obtained (e.g. the difference between density for control electrodes at ON-voltage and density for control electrodes at OFF-voltage) is very dependent upon the type of printhead structure used. If e.g. a printhead structure as described in U.S. Pat. No. 3,689,935, made from 2 electrode planes isolated by an insulating plastic member (P2-printhead structure), is used, then many different levels of grey can be easily obtained by voltage modulation or time modulation of the control voltage applied on said control electrodes, i.e. a large tone scale can be printed. This is not only so for grey scale printing, but also for the printing of a large tonal range in colour images. The voltage level needed to block completely the toner flux, in order to get image parts with no density, is rather high. In a printhead structure, wherein said insulating material is thin (a thin insulating material is advantageous for preventing said printing apertures from clogging), said high control voltages can short-circuit the shield electrode and the individual control electrodes, through the printing aperture surrounded by both apertures. This short-circuiting deteriorates the printhead structure and/or driving IC's leading to malfunction of the printing device.

The printhead structures according to U.S. Pat. No. 3,689,935 but with only a single plane of control electrodes (P1-printhead structures) were found to provide a much higher image contrast compared with said P2-printhead structures, i.e. can only print a small tone scale. It was found that short-circuiting and image degradation was less important for these printhead structures. Moreover, it was found that the control voltage needed to block the toner flux from toner applicator device to final image receiving member was much lower than the control voltage needed for a printhead structure according to a P2-structure. For printing images with enhanced density resolution (i.e. a large number of density levels between maximum density and minimum density or having a large tonal range or tone scale) said P1-printhead structures are less suitable.

Several modifications in printhead structures have been described in e.g. U.S. Pat. Nos. 4,912,489, 5,170,185 and 5,038,159. The printhead structures described in these documents do alleviate some of the problem of P2 and/or P1 printhead structures, but the manufacturing process for these adapted printhead structures is quite complicated making said printhead structures expensive and less suitable for implementation into DEP-devices with an excellent compromise between manufacturing cost and image quality.

Printhead structure of the P1 type, i.e. not comprising a shield electrode, showing segmented control electrodes have been disclosed in, e.g. U.S. Pat. No. 5,515,084, JP-A 61/110567 and EP-A 720 072. These modifications of a P1 type printhead structure do not overcome the drawbacks of such a type of printhead structure and are still less well suited for printing images with enhanced density resolution (i.e. a large number of density levels between maximum density and minimum density or having a large tonal range or tone scale).

It has been found that the problems above can be mastered when a printhead structure of the P2 type is made wherein, either the shield electrode or the control electrodes or both do not reach as far as the edge of the printing apertures. Therefore a printhead structure is manufactured comprising, an insulating material (106*c*) having a first and a second side, said first side carrying control electrodes (106*a*) associated with printing apertures, said second side carrying a shield electrode (106*b*), wherein i) said printing apertures have a longest dimension A, measured on said side of said insulating material carrying said shield electrode and have a longest dimension D, measured on said side of said insulating material carrying said control electrodes, ii) said shield electrode has openings with a dimension B, measured parallel to said longest dimension A, said dimension B being equal to or larger than said dimension A, iii) said control electrodes have openings with a dimension E measured parallel to said longest dimension D, said dimension E being equal to or larger than said dimension D, iv) in each of said openings at least one printing aperture is present, and v) for each of said printing apertures present in each of said openings, $B/A \geqq 1.10$ or $E/D \geqq 1.10$.

There are several embodiments of a printhead structure according to the present invention.

Figure 3A:
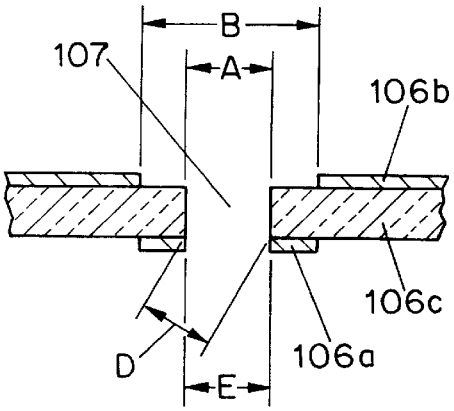
FIG. 3 is a schematic illustration of a cross-section of further embodiments of a printhead structure according to the present invention.
Figure 2A:
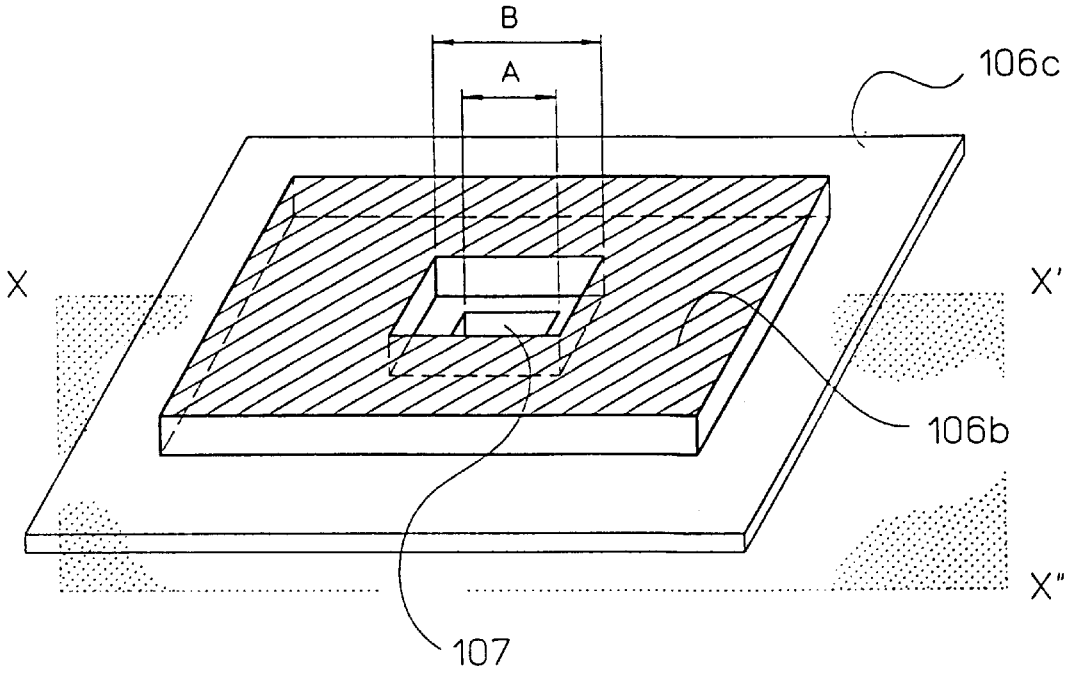
FIG. 2 is a schematic illustration of two embodiments of a printhead structure according to the present invention.
Figure 2B:
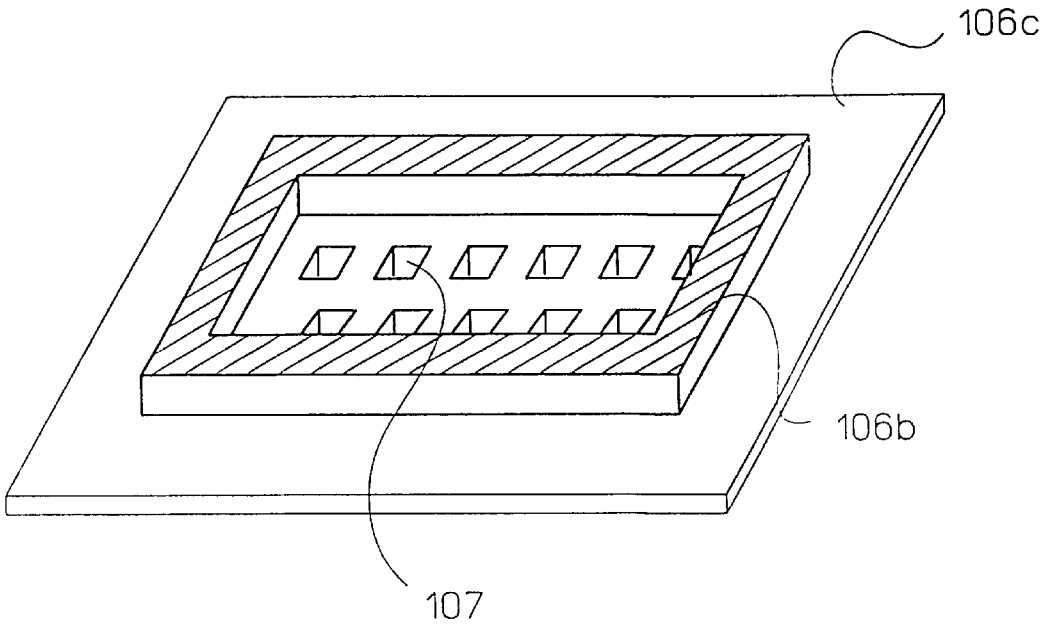

In a first embodiment, the control electrodes reach as far as the edges of the printing apertures associated with each of the control electrodes, i.e. E=D and the shield electrode does not reach as far as the edges of the printing apertures. Such a printhead structure has been illustrated in FIG. 2*a*. In this FIG. 106*b* is the shield electrode, 106*c* represents the insulating material, and 107 represents a printing aperture. In the FIG. 2*a*, only one printing aperture is present in the opening of the shield electrode. The control electrode on the other side of the insulating material is not shown. In this figure, A, represents the longest dimension of the printing apertures measured on said side of said insulating material carrying said shield electrode and B represents the dimension of the opening in the shield electrode measured in the direction of said longest dimension (A). A cross section through such a printhead structure, along the plane X,X' and X" (FIG. 2*a*), is shown in FIG. 3*a*. The printing aperture (107) has a longest dimension A and the shield electrode (106*b*) has an opening with dimension B measured in the same direction as dimension A. Dimension B is larger than dimension A so that $B/A \geqq 1.10$. At the other side of the insulating material (106*c*) a control electrode (106*a*) is present around printing aperture 107. The control electrode extends as far as the edge of the printing aperture, and the longest dimension D (i.e. D=E). A printhead structure, wherein more than one printing aperture is present in the opening in the shield electrode, is also within the scope of this first embodiment of a printhead structure according to the present invention. A printhead structure, wherein the shield electrode 106*b* is only a thin track of conducting material surrounding all arrays of printing apertures (107), as illustrated in FIG. 2*b*, is also within the scope of this first embodiment of the present invention. In this first embodiment of the present invention, when D=E, it is preferred that for each of the printing apertures, comprised in the opening of the shield electrode, $1.5 \leqq B/A \leqq 15$, it is more preferred that $2 \leqq B/A \leqq 10$.

Hereinafter the "longest dimension" of a printing aperture has to be understood as the diameter of the circle defining said printing aperture in the case of circular printing apertures, as the side of the square defining said printing aperture in the case of square printing apertures, as the longest side of the rectangle defining said printing apertures in the case of rectangular printing apertures, as the longest axis of the ellipse defining said printing aperture in the case of elliptic printing apertures. When the printing aperture is defined by a polygon (either regular or irregular), the longest dimension is to be understood as the diameter of the smallest circumscribed circle.

Figure 3B:
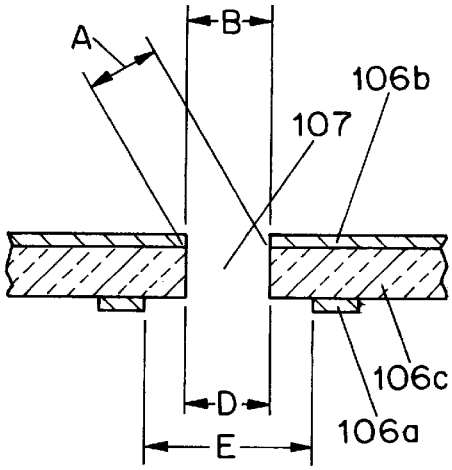

In a second embodiment of the invention, the shield electrode reaches as far as the edges of the printing apertures, i.e. A=B, and E>D. It was found that such a P2 printhead structure also gives low incidence of short-circuiting and makes it possible to print a large tone scale (i.e. many different density levels) when the control electrodes surrounding the printing apertures were not present as far as the edge of the printing apertures. Thus also a P2 printhead structure, wherein the shield electrode reaches as far as the edges of the printing apertures (i.e. A=B) and the control electrodes do not reach as far as the edges of the printing apertures associated with them, is within the scope of this invention. Such a printhead structure is illustrated in FIG. 3*b*. In FIG. 3*b*, the printing aperture (107) has a longest dimension D, measured on said side of said insulating material carrying said control electrodes and a longest dimension A, measured on said side of said insulating material carrying said shield electrode, the shield electrode (106*b*) has an opening with dimension B measured in the same direction as dimension A. At the other side of the insulating material (106*c*) a control electrode (106*a*) is present around printing aperture 107. The control electrode, has an opening with dimension E measured in the same direction as dimension D. Dimension B is equal to dimension A (i.e. the shield electrode extends as far as the edges of the printing aperture) and the dimension E>D, such that $E/D \geqq 1.10$. In this second embodiment of the present invention, for each of the printing apertures, preferably, $1.25 \leqq E/D \leqq 15$, and more preferably $2 \leqq E/D \leqq 10$. A printhead structure wherein more than one printing aperture is associated with a single control electrode is within the scope of this embodiment of the present invention, as long as for each of the printing apertures associated with said single control electrode the relations between D and E, detailed above, are fulfilled.

Figure 3C:
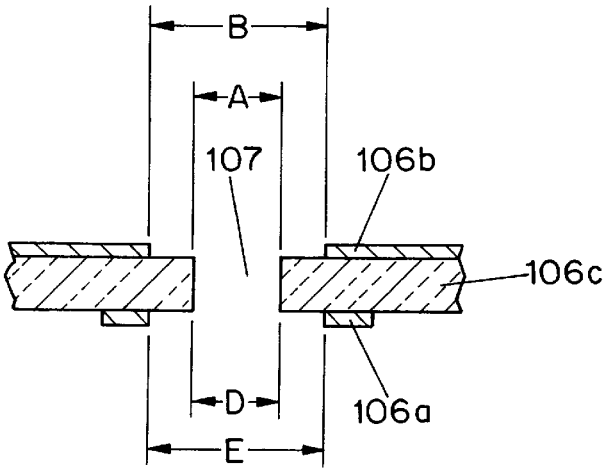

In a third embodiment of the invention a printhead structure is provide wherein both the control electrodes and the shield electrode do not reach as far as the edges of the printing apertures. Such a printhead structure is illustrated in FIG. 3*c*. In FIG. 3*b*, the printing aperture (107) has a longest dimension D, measured on said side of said insulating material carrying said control electrodes and a longest dimension A, measured on said side of said insulating material carrying said shield electrode, the shield electrode (106*b*) has an opening with dimension B measured in the same direction as dimension A. At the other side of the insulating material (106*c*) a control electrode (106*a*) is present around printing aperture 107. The control electrode, has an opening with dimension E measured in the same direction as dimension D. Dimension B is larger than dimension A (i.e. the shield electrode does not extend as far as the edges of the printing aperture), and $B/A \geqq 1.10$ and the dimension E>D, (i.e. the control electrode does not extend as far as the edges of the printing aperture), such that $E/D \geqq 1.10$. In a preferred implementation of this third embodiment of the invention, $1.5 \leqq B/A \leqq 15$ and $1.25 \leqq E/D \leqq 15$; in a more preferred embodiment $2 \leqq B/A \leqq 10$ and $2 \leqq E/D \leqq 10$.

The insulating material contained in a printhead structure according to the present invention can be any insulating material known in the art, e.g. ceramic materials, glass, plastic, etc. It is preferred to use plastic materials as insulating material in a printhead structure of the present invention or thin glass (thickness lower than 400 $\mu$m) having a failure stress (under tensile stress) equal to or higher than $1 \times 10^7$ Pa and an elasticity modulus (Young's modulus) equal to or lower than $10 \times 10^{10}$ Pa.

The thickness of the insulating material is preferably between 10 and 200 $\mu$m, mote preferably between 50 and 100 $\mu$m.

The printing apertures of a printhead structure according to the present invention can have any form, they can be circular, elliptic, square, rectangular, etc. The printing apertures in a printhead structure according to the present invention can be of the type wherein each individual control electrode surrounds at least two apertures (107), both with an aspect ratio AR>1 and part of said control electrode separates said apertures (107). Such printhead structure have been disclosed in EP-A 754 557.

Printhead structures according to the present invention can be made in an easy and convenient way as known to those skilled in the art. It is e.g. possible to start from conventional polyimide foil with double side clad copper surfaces. First of all the control electrodes with printing apertures and conductive patterns are etched on one side of said flexprint material. Second the pattern of the common shield electrode is etched at the other side of said flexprint material. Both sides are registered so that the centre of each printing aperture is well aligned for both shield electrode side and control electrode side. The apertures can be made by different techniques such as e.g. excimer laser burning from the control electrode side making use of the copper control electrode as mask for the laser light. Additional cleaning such as plasma etching can be applied in order to obtain a better quality regarding aperture definition and insulating power. Additional thin protective dielectric coatings can be applied over said conductive patterns and/or insulating material.

The insulation quality is improved by applying typical thin dielectric coatings above said patterned structure.

Description of the Dep Device

A DEP device, comprising a printhead structure according to this invention, comprises essentially a) toner delivery means, b) means for attracting charged toner particles to a substrate, c) means for forming a toner flow from said toner delivery means towards said substrate, and d) means for image wise modulating said toner flow.

Said means for image wise modulating said toner flow comprise a printhead structure according to this invention.

Figure 4:
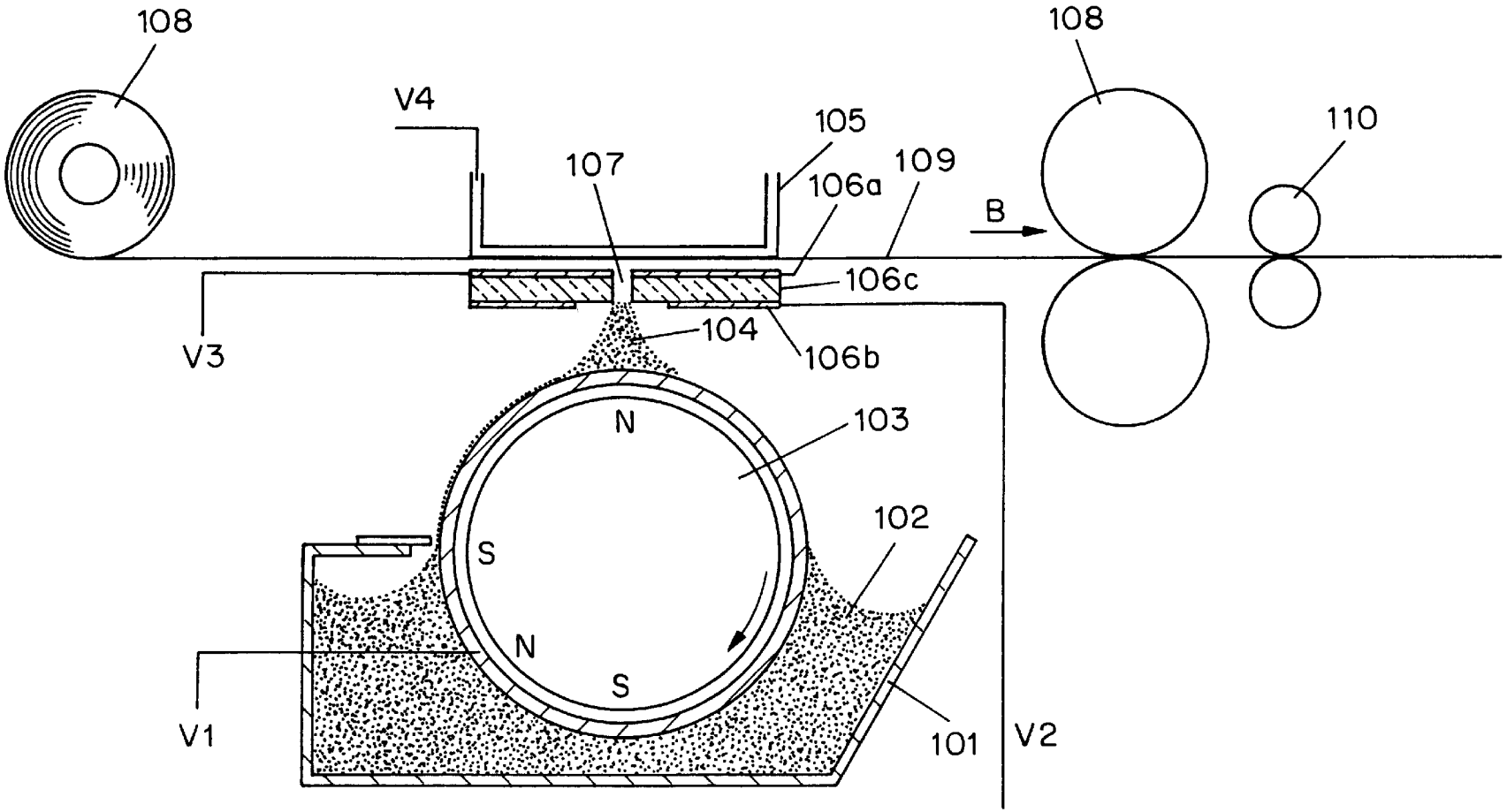
FIG. 4 is a schematic illustration of a possible embodiment of a DEP device incorporating a printhead structure according to the present invention.

In FIG. 4, a non limitative example of a device for implementing a DEP device incorporating a printhead structure according to the present invention, is shown.

The DEP device shown in FIG. 4 comprises:

(i) a toner delivery means (101), comprising a container for developer (102) and a magnetic brush assembly (103), this magnetic brush assembly forming a toner cloud (104)

(ii) a back electrode (105)

(iii) a printhead structure, made from a plastic insulating film (106*c*), coated on both sides with a metallic film. The printhead structure comprises one continuous electrode surface, hereinafter called "shield electrode" (106*b*) facing in the shown embodiment the toner delivery means and a complex addressable electrode structure, hereinafter called "control electrode" (106*a*) around printing apertures (107), facing, in the shown embodiment, the toner receiving member in said DEP device. The location and/or form of the shield electrode (106*b*) and the control electrode (106*a*) can, in other embodiments of a device for a DEP method, be different from the location shown in FIG. 4.

(iv) conveyer means (108) to convey an image receptive member (109) for said toner between said printhead structure and said back electrode in the direction indicated by arrow B.

(v) means for fixing (110) said toner onto said image receptive member.

The back electrode (105) of this DEP device can also be made to cooperate with the printhead structure, said back electrode being constructed from different styli or wires that are galvanically insulated and connected to a voltage source as disclosed in e.g. U.S. Pat. Nos. 4,568,955 and 4,733,256. The back electrode, cooperating with the printhead structure, can also comprise one or more flexible PCB's (Printed Circuit Board).

Between said printhead structure and the magnetic brush assembly (103) as well as between the control electrode around the printing apertures (107) and the back electrode (105) behind the toner receiving member (109) as well as on the single electrode surface or between the plural electrode surfaces of said printhead structure different electrical fields are applied. In the specific embodiment of a device, useful for a DEP method, shown in FIG. 4, voltage V1 is applied to the sleeve of the magnetic brush assembly 103, voltage V2 to the shield electrode 106*b*, voltages $V3_0$ up to $V3_n$ for the control electrode (106*a*). The value of V3 is selected, according to the modulation of the image forming signals, between the values $V3_0$ and $V3_n$, on a time basis or grey-level basis. Voltage V4 is applied to the back electrode behind the toner receiving member, the potential difference V4–V1 creates a propulsion field wherein toner particles flow from the toner delivery means to the image receptive member. In other embodiments of the present invention multiple voltages $V2_0$ to $V2_n$ and/or $V4_0$ to $V4_n$ can be used.

In a DEP device according to a preferred embodiment of the present invention, said toner delivery means 101 creates a layer of multi-component developer on a magnetic brush assembly 103, and the toner cloud 104 is directly extracted from said magnetic brush assembly 103. In other systems known in the art, the toner is first applied to a conveyer belt and transported on this belt in the vicinity of the printing apertures. A device according to the present invention is also operative with a mono-component developer or toner, which is transported in the vicinity of the printing apertures (107), via a conveyer for charged toner. Such a conveyer can be a moving belt or a fixed belt. The latter comprises an electrode structure generating a corresponding electrostatic travelling wave pattern for moving the toner articles.

The magnetic brush assembly (103) preferentially used in a DEP device according to an embodiment of the present invention can be either of the type with stationary core and rotating sleeve or of the type with rotating core and rotating or stationary sleeve.

Several types of carrier particles, such as described in EP-A 675 417 can be used in a preferred embodiment of the present invention.

Any toner particles, black, coloured or colourless, can be used in a DEP device comprising a printhead structure according to the present invention. It is preferred to use toner particles as disclosed in EP-A 715 218, that is incorporated by reference, in combination with a printhead structure according to the present invention.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the, voltage V3 applied on the control electrode 106*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution, obtained by the small-diameter printing apertures (107), and of the multiple grey level capabilities typical for DEP, opens the way for multilevel halftoning techniques, such as described in EP-A 634 862. This enables the DEP device, according to the present invention, to render high quality images.

EXAMPLES

A printhead structure was made from a polyimide film of 50 μm thickness (insulating material 106*c*), double sided coated with a 17.5 μm thick copper film. The printhead structure had two rows of printing apertures. On the back side of the printhead structure, facing the receiving member substrate, a square shaped control electrode (106*a*) was arranged around each aperture. Each of said control electrodes was individually addressable from a high voltage power supply. On the front side of the printhead structure, facing the toner delivery means, a common shield electrode (106*b*) was present. The printing apertures were square and had a longest dimension, measured at the side of the shield electrode, A, of 200 μm. The printing apertures had a longest dimension, measured at the side of the control electrodes, D of 200 μm. The total width of the square shaped copper control electrodes was 300 micron, the longest dimension of their opening E was also 200 micron. The dimension of the opening in the common shield electrode, measured in the direction of the longest dimension of the printing apertures present in said opening of said shield electrode, B, was 300 μm. The ratio B/A was thus 1.50 and the ratio E/D was 1.00. Said printhead structure was fabricated in the following way. First of all the control electrode pattern was etched by conventional copper etching techniques. Then the shield electrode pattern was etched by conventional copper etching techniques. The apertures were made by a step and repeat focused excimer laser making use of the control electrode patterns as focusing aid. After excimer burning the printhead structure was cleaned by a short isotropic plasma etching cleaning. Finally a thin coating of PLASTIK70 (trade name), commercially available from Kontakt Chemie, CRC Industries NV, Belgium was applied over both surfaces of said printhead structure.

The toner delivery means (101) was a stationary core/rotating sleeve type magnetic brush comprising two mixing rods and one metering roller. One rod was used to transport the developer through the unit, the other one to mix toner with developer.

The magnetic brush assembly (103) was constituted of the so called magnetic roller, which in this case contained inside the roller assembly a stationary magnetic core, showing nine magnetic poles of 500 Gauss (0.05 T) magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (Ra<50 μm).

A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit. The magnetic brush assembly (103) was connected to an AC power supply with a square wave oscillating field of 600 V at a frequency of 3.0 kHz with 0 V DC-offset.

A macroscopic "soft" ferrite carrier consisting of a MgZn-ferrite with average particle size 50 $\mu$m, a magnetisation at saturation of 29 emu/g (36.5 $\mu$T.m$^3$/kg) was provided with a 1 $\mu$m thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3N^+C_{16}H_{33}Br^-$ was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 $\mu$m average by number and 8.2 $\mu$m average by volume. In order to improve the flowability of the toner mass, the toner particles were mixed with 0.5% of hydrophobic colloidal silica particles (BET-value 130 m$^2$/g).

An electrostatographic developer was prepared by mixing said mixture of toner particles and colloidal silica in a 4% ratio (w/w) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to a method as described in the above mentioned EP-A 675 417, giving q=−7.1 fC, q as defined in said application.

The distance l between the front side of the printhead structure (106) and the sleeve of the magnetic brush assembly (103), was set at 450 $\mu$m. The distance between the back electrode (105) and the back side of the printhead structure (106) (i.e. control electrodes 106*a*) was set to 500 $\mu$m and the paper travelled at 1 cm/sec. The shield electrode (106*b*) was grounded: V2=0 V. To the individual control electrodes an (imagewise) voltage V3 between 0 V and −300 V was applied. The back electrode (105) was connected to a high voltage power supply of +1500 V. To the sleeve of the magnetic brush an AC voltage of 600 V at 3.0 kHz was applied, without DC offset.

Examples 2–12

A printhead structure was fabricated in the same way as described for example 1, except that the longest dimension of the printing apertures, measured at the side of the shield electrode, (A), the longest dimension of the printing apertures, measured at the side of the control electrodes, (D), the dimension of the opening in shield electrode, measured in the direction of the longest dimension of the printing apertures (B) and the dimension of the opening in the control electrode, measured in the direction of the longest dimension of the printing apertures (E) were modified. The modifications are summarized in table 1.

Comparative examples CE1 and CE2

For comparative examples CE1 and CE2 prior art printhead structures P2 and P1 were used, fabricated in the same way as described above. For CE1 both the shield electrode and the control electrodes reached as far as the edges of the printing aperture. This was a printhead structure of the P2 type.

For CE2 the shield electrode layer was completely omitted and the control electrodes reached as far as the edges of the printing apertures. This was a printhead structure of the P1 type.

The Printing

Grey scale images with 16 time-modulated levels were printed with all printhead structures as tabulated in table 1.

The extent of the tone scale that could be printed with a printhead structure of the P1 type, comparative example 2 (CE2), was measured as the average slope of the curve D versus time-modulated grey level value in the D range 0.2 Dmax to 0.8 Dmax. This extent of printed tone scale was set to be 1.00, and the extent of tone scale that could be printed with the other printhead structure of the examples and comparative example were related to said extent of tone scale. A larger figure means that a larger tone scale could be printed. These figure are presented in table 1 under the heading "ton".

The reliability of the printhead structure was determined as the number of defect printing apertures (probably due to short-circuiting of shield and control electrode) after applying a control electrode voltage of 500 V between said control electrodes and shield electrode (or earth) for one hour. The number of defects in a P2 type printhead (comparative example 1, (CE1)), was set to 1.00, the defects of the other printhead structures were related to the number of defects of the printhead structure of the P2 type, so that a lower figure is better. These values are also tabulated in table 1 under the heading 'def'.

TABLE 1

| | Printing aper* | | Shield† | Control+ | | | | |
|---|---|---|---|---|---|---|---|---|
| Ex # | A | D | B | E | B/A | E/D | Def | Ton |
| 1 | 200 | 200 | 300 | 200 | 1.50 | 1.00 | 20 | 212 |
| 2 | 200 | 200 | 350 | 200 | 1.75 | 1.00 | 7 | 164 |
| 3 | 200 | 200 | 400 | 200 | 2.00 | 1.00 | 2 | 152 |
| 4 | 200 | 200 | 1,100 | 200 | 5.50 | 1.00 | 0 | 118 |
| 5 | 200 | 200 | 3,000 | 200 | 15.0 | 1.00 | 0 | 113 |
| 6 | 200 | 200 | 5,000 | 200 | 25.0 | 1.00 | 0 | 113 |
| 7 | 200 | 200 | 7,000 | 200 | 35.0 | 1.00 | 0 | 112 |
| 8 | 200 | 200 | 20,000 | 200 | 200 | 1.00 | 0 | 106 |
| 9 | 100 | 100 | 100 | 120 | 1.00 | 1.20 | 50 | 243 |
| 10 | 100 | 100 | 100 | 140 | 1.00 | 1.40 | 40 | 243 |
| 11 | 100 | 100 | 100 | 150 | 1.00 | 1.50 | 25 | 236 |
| 12 | 100 | 100 | 100 | 170 | 1.00 | 1.70 | 15 | 212 |
| CE1 | 200 | 200 | 200 | 200 | 1.00 | 1.00 | 100 | 257 |
| CE2 | 200 | 200 | np | 200 | np | 1.00 | 0 | 100 |

*Longest dimension of the printing apertures:
A: measured at the side of the insulating material carrying the shield electrode in $\mu$m.
D: measured at the side of the insulating material carrying the control electrode in $\mu$m.
+B: dimension of the opening in the shield electrode measured in the direction of longest dimension A, in $\mu$m.
†: dimension of the opening in the control electrode measured in the direction of longest dimension D, in $\mu$m.
Def: percentage of the number of defects compared to CE1
Ton: relative extension of the printable tone scale compared to CE2.
np: not present From table 1 it is clear that the printhead structures according present invention can offer a combination of stable results short-circuiting and the possibility of printing a fairly tone scale (a high density resolution).

We claim:

1. A device for direct electrostatic printing on an image-receiving substrate, comprising:

a surface carrying dry charged toner particles and coupled to a voltage source creating a flow of charged toner particles away from said surface towards said image-receiving substrate; and a printhead structure placed in said flow between said surface carrying toner particles and said substrate, said printhead structure comprising:

(i) an insulating material having first and second sides; and (ii) printing apertures in said insulating material extending from said first side to said second side, each printing aperture having a long dimension A measured on said second side and a long dimension D measured on said first side, (iii) wherein said first side carries a control electrode associated with each said printing aperture and said second side carries a common shield electrode;

(iv) and wherein:

said shield electrode has openings associated with said printing apertures, each said shield electrode opening having a dimension B measured parallel to said dimension A;

each of said control electrodes has an opening associated with one of said printing apertures, each said control electrode opening being substantially centered on said associated printing aperture and having a dimension E measured parallel to said dimension D; and $B/A \geqq 1.1$ and $E \geqq D$.

2. The printhead structure according to claim 1, wherein $E=D$.

3. The printhead structure according to claim 2, wherein $1.5 \leqq B/A \leqq 15$.

4. The printhead structure according to claim 3, wherein $2 \leqq B/A \leqq 10$.

5. The printhead structure according to claim 1, wherein $1.5 \leqq B/A < 15$ and $1.25 \leqq E/D \leqq 15$.

6. The printhead structure according to claim 5, wherein $2 \leqq B/A \leqq 10$ and $2 \leqq E/D \leqq 10$.

7. A device for direct electrostatic printing on an image-receiving substrate, comprising:

a surface carrying dry charged toner particles and coupled to a voltage source creating a flow of charged toner particles away from said surface towards said image-receiving substrate; and a printhead structure placed in said flow between said surface carrying toner particles and said substrate, said printhead structure comprising:

(i) an insulating material having first and second sides; and (ii) printing apertures in said insulating material extending from said first side to said second side, each printing aperture having a long dimension A measured on said second side and a long dimension D measured on said first side, (iii) wherein said first side carries a control electrode associated with each said printing aperture and said second side carries a common shield electrode;

(iv) and wherein:

said shield electrode has openings associated with said printing apertures, each said shield electrode opening having a dimension B measured parallel to said dimension A;

each of said control electrodes has an opening associated with one of said printing apertures, each said control electrode opening being substantially centered on said associated printing aperture and having a dimension E measured parallel to said dimension D; and $B \geqq A$ and $E/D \geqq 1.1$.

8. The printhead structure according to claim 7, wherein $B=A$.

9. The printhead structure according to claim 8, wherein $1.5 \leqq E/D \leqq 15$.

10. The printhead structure according to claim 9, wherein $2 \leqq E/D \leqq 10$.

* * * * *